US009489953B2

(12) United States Patent
Christoph et al.

(10) Patent No.: US 9,489,953 B2
(45) Date of Patent: Nov. 8, 2016

(54) DIRECTIONAL CODING CONVERSION

(71) Applicant: Harman Becker Automotive Systems GmbH, Karlsbad (DE)

(72) Inventors: Markus Christoph, Straubing (DE); Florian Wolf, Regensburg (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 211 days.

(21) Appl. No.: 14/295,841

(22) Filed: Jun. 4, 2014

(65) Prior Publication Data

US 2014/0362998 A1 Dec. 11, 2014

(30) Foreign Application Priority Data

Jun. 11, 2013 (EP) ..... 13171535

(51) Int. Cl.

| | |
|---|---|
| ***H04R 5/00*** | (2006.01) |
| ***G10L 19/008*** | (2013.01) |
| ***H04S 3/00*** | (2006.01) |
| ***H04S 3/02*** | (2006.01) |
| ***H04S 7/00*** | (2006.01) |
| *G10L 19/16* | (2013.01) |

(52) U.S. Cl.

CPC ..... *G10L 19/008* (2013.01); *G10L 19/173* (2013.01); *H04S 3/008* (2013.01); *H04S 3/02* (2013.01); *H04S 7/30* (2013.01); *G10L 19/167* (2013.01); *H04R 2499/13* (2013.01)

(58) Field of Classification Search

USPC ..... 381/22

See application file for complete search history.

(56) References Cited

U.S. PATENT DOCUMENTS

2008/0130917 A1* 6/2008 Kong ..... G10L 19/18 381/107
2008/0232617 A1 9/2008 Goodwin et al.
2012/0230534 A1 9/2012 Pan et al.

FOREIGN PATENT DOCUMENTS

WO 2008113428 A1 9/2008

OTHER PUBLICATIONS

Pulkki, "Spatial Sound Generation and Perception by Amplitude Panning Techniques", Helsinki University of Technology, Laboratory of Acoustics and Audio Signal Processing, Espoo, Finland, 2001, Report 62, 44 pages.

Pulkki, "Compensating Displacement of Amplitude-Panned Virtual Sources", AES 22nd International Conference on Virtual, Synthetic and Entertainment Audio, Finland, Jun. 2002, 10 pages.

(Continued)

*Primary Examiner* — Quynh Nguyen
(74) *Attorney, Agent, or Firm* — Brooks Kushman P.C.

(57) ABSTRACT

A directional coding conversion method and system includes receiving input audio signals that comprise directional audio coded signals into which directional audio information is encoded according to a first loudspeaker setup and extracting the directional audio coded signals from the received input audio signals. The method and system further includes decoding, according to the first loudspeaker setup, the extracted directional audio coded signals to provide at least one absolute audio signal and corresponding absolute directional information and processing the at least one absolute audio signal and the absolute directional information to provide first output audio signals coded according to a second loudspeaker setup.

17 Claims, 5 Drawing Sheets

(56) References Cited

OTHER PUBLICATIONS

European Search Report for corresponding Application No. 13171535.1, mailed Oct. 24, 2013, 7 pages.

Communication Under Rule 71(3) EPC for corresponding Application No. 13 171 535.1, mailed Apr. 6, 2016, 7 pages.

* cited by examiner

DIRECTIONAL CODING CONVERSION

CROSS-REFERENCE TO RELATED APPLICATIONS

This application claims priority to EP Application No. 13 171 535.1 filed on Jun. 11, 2013, the disclosure of which is incorporated in its entirety by reference herein.

TECHNICAL FIELD

The disclosure relates to a system and method (generally referred to as a "system") for processing a signal, in particular audio signals.

BACKGROUND

Two-dimensional (2D) and three-dimensional (3D) sound techniques present a perspective of a sound field to a listener at a listening location. The techniques enhance the perception of sound spatialization by exploiting sound localization (i.e., a listener's ability to identify the location or origin of a detected sound in direction and distance). This can be achieved by using multiple discrete audio channels routed to an array of sound sources (e.g., loudspeakers). In order to detect an acoustic signal from any arbitrary, subjectively perceptible direction, it is necessary to know about the distribution of the sound sources. Known methods that allow such detection are, for example, the well-known and widely used stereo format and the Dolby Pro Logic II® format, wherein directional audio information is encoded into the input audio signal to provide a directionally (en)coded audio signal before generating the desired directional effect when reproduced by the loudspeakers. Besides such specific encoding and decoding procedures, there exist more general procedures such as panning algorithms, (e.g., the ambisonic algorithm and the vector base amplitude panning (VBAP) algorithm). These algorithms allow encoding/decoding of directional information in a flexible way so that it is no longer necessary to know while encoding about the decoding particulars so that encoding can be decoupled from decoding. However, further improvements are desirable.

SUMMARY

A directional coding conversion method includes: receiving input audio signals that include directional audio coded signals into which directional audio information is encoded according to a first loudspeaker setup and extracting the directional audio coded signals from the received input audio signals. The method further includes decoding, according to the first loudspeaker setup, the extracted directional audio coded signals to provide at least one absolute audio signal and corresponding absolute directional information and processing the at least one absolute audio signal and the absolute directional information to provide first output audio signals coded according to a second loudspeaker setup.

A directional coding conversion system includes input lines, an extractor block, a decoder block, and a first processor block. The input lines are configured to receive input audio signals that include directional audio coded signals into which directional audio information is encoded according to a first loudspeaker setup. The extractor block is configured to extract the directional audio coded signals from the received input audio signals. The decoder block is configured to decode, according to the first loudspeaker setup, the extracted directional audio coded signals to provide at least one absolute audio signal and corresponding absolute directional information. The first processor block is configured to process the at least one absolute audio signal and the absolute directional information to provide first output audio signals coded according to a second loudspeaker setup.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
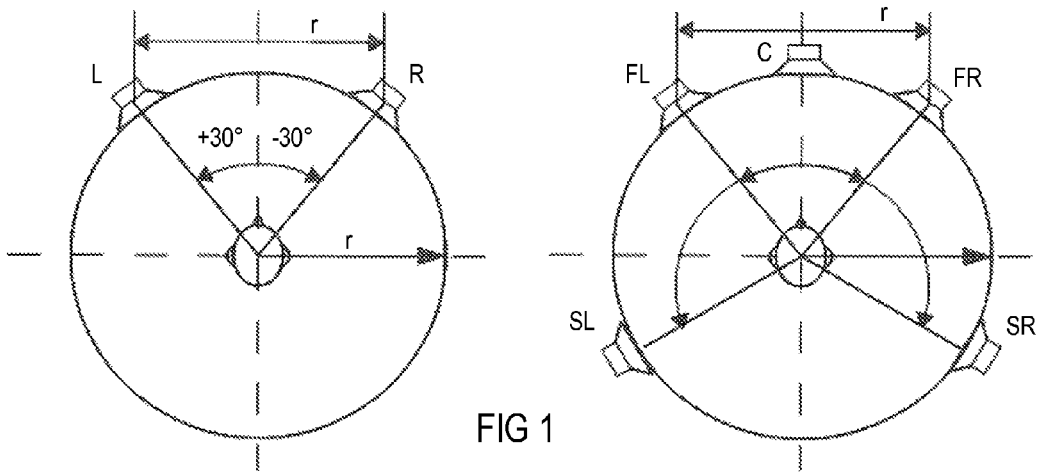
FIG. 1 is a diagram of an example of a 2.0 loudspeaker setup and a 5.1 loudspeaker setup.

The stereo format is based on a 2.0 loudspeaker setup and the Dolby Pro Logic II® format is based on a 5.1 ("five point one") loudspeaker setup, where the individual speakers have to be distributed in a certain fashion, for example, within a room, as shown in FIG. 1, in which the left diagram of FIG. 1 refers to the stereo loudspeaker setup and the right diagram to the Dolby Pro Logic II® loudspeaker setup. All 5.1 systems use the same six loudspeaker channels and configuration, having five main channels and one enhancement channel, for example, a front left loudspeaker FL and front right loudspeaker FR, a center loudspeaker C and two surround loudspeakers SL and SR as main channels, and a subwoofer Sub (not shown) as an enhancement channel. A stereo setup employs two main channels, for example, loudspeakers L and R, and no enhancement channel. The directional information must be first encoded into the stereo or 5.1 input audio signal (for example) before they are able to generate the desired directional effect when fed to the respective loudspeakers of the respective loudspeaker setups.

These formats may be used to gather directional information out of directionally (en)coded audio signals generated for a designated loudspeaker setup, which can then be redistributed to a different loudspeaker setup. This procedure is hereafter called "Directional Coding Conversion" (DCC). For example, the 5.1 format may be converted into a 2.0 format and vice versa.

Figure 2:
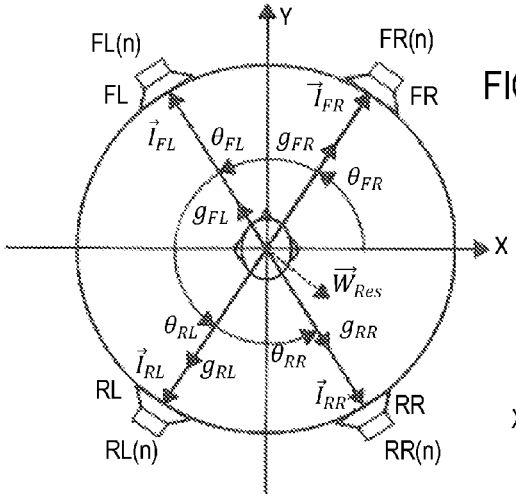
FIG. 2 is a diagram of an example of a quadrophonic (4.0) loudspeaker setup.

Referring to FIG. 2, four signals, for example, front left FL (n), front right FR (n), rear left RL(n), and rear right RR(n), are supplied to a quadrophonic loudspeaker setup including front left loudspeaker FL, front right loudspeaker FR, rear left loudspeaker RL, and rear right loudspeaker RR, and determine the strength and direction of a resulting signal $\vec{W}_{Res}(n)$. Unit vectors $\vec{1}_{FL}$, $\vec{1}_{FR}$, $\vec{1}_{RL}$ and $\vec{1}_{RR}$ point to the position of the four loudspeakers FL, FR, RL, and RR, defined by four azimuth (horizontal) angles $\theta_{FL}$, $\theta_{FR}$, $\theta_{RL}$, and $\theta_{RR}$. The current gains of the signals, denoted $g_{FL}$, $g_{FR}$, $g_{RL}$, and $g_{RR}$, scale the unit vectors, such that the resulting vector sum corresponds with the current resulting vector $\vec{W}_{Res}(n)$.

The main and secondary diagonal vectors $\vec{W}_{Main}$ and $\vec{W}_{secondary}$ can be calculated as follows:

if $\theta_{RL}=\theta_{FR}+180°$ and $\theta_{RR}=\theta_{FL}+180°$, then $\vec{W}_{Main}=(g_{FL}-g_{RR})e^{j\theta_{FL}}$ and $\vec{W}_{Secondary}=(g_{FR}-g_{RL})e^{j\theta_{FR}}$ applies.

The resulting vector $\vec{W}_{Res}(n)$ can be generally calculated as follows:

$$\begin{aligned}\vec{W}_{Res} &= \vec{W}_{Main} + \vec{W}_{Secondary}\\ &= (g_{FL}-g_{RR})e^{j\theta_{FL}} + (g_{FR}-g_{RL})e^{j\theta_{FR}}\\ &= \left(\Re\{\vec{W}_{Main}\} + \Re\{\vec{W}_{Secondary}\}\right) + j\left(\Im\{\vec{W}_{Main}\} + \Im\{\vec{W}_{Secondary}\}\right)\\ &= ((g_{FL}-g_{RR})\sin(\theta_{FL}) + (g_{FR}-g_{RL})\sin(\theta_{FR})) +\\ &\quad j((g_{FL}-g_{RR})\cos(\theta_{FL}) + (g_{FR}-g_{RL})\cos(\theta_{FR})).\end{aligned}$$

If $\theta_{FL}=45°$ and $\theta_{FR}=135°$, then the resulting vector $\vec{W}_{Res}(n)$ can be calculated in a simplified manner:

$$\begin{aligned}\vec{W}_{Res} &= \Re\{\vec{W}_{Res}\} + j\Im\{\vec{W}_{Res}\}\\ &= \frac{1}{\sqrt{(2)}}\left(\left(g_{FL} \overset{g_{Front}}{\hat{+}} g_{FR}\right) - \left(g_{RL} \overset{g_{Rear}}{\hat{+}} g_{RR}\right)\right) +\\ &\quad \frac{j}{\sqrt{(2)}}\left(\left(g_{FR} \overset{g_{Right}}{\hat{+}} g_{RR}\right) - \left(g_{FL} \overset{g_{Left}}{\hat{+}} g_{RL}\right)\right).\end{aligned}$$

The length $g_{Res}(n)$ and the horizontal angle (azimuth) $\theta_{Res}(n)$ of the current resulting vector $\vec{W}_{Res}(n)$ calculates to:

$$g_{Res}(n) = \sqrt{\Re\{\vec{W}_{Res}(n)\}^2 + \Im\{\vec{W}_{Res}(n)\}^2}\text{, and}$$

$$\theta_{Res}(n) = \arctan\left\{\frac{\Im\{\vec{W}_{Res}(n)\}}{\Re\{\vec{W}_{Res}(n)\}}\right\}\text{, with } \theta_{Res}(n) \in [0, \ldots, 2\pi].$$

In the example illustrated above, the steering vector has been extracted out of four already coded input signals of a two-dimensional, for example, a pure horizontally arranged system. It can be straightforwardly extended for three-dimensional systems as well, if, for example, the input signals stem from a system set up for a three-dimensional loudspeaker arrangement or if the signals stem from a microphone array such as a modal beamformer, in which one can extract the steering vector directly from the recordings.

Figure 3:
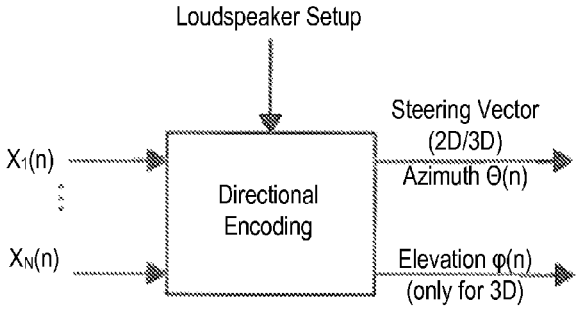
FIG. 3 is a block diagram of an example of a general directional encoding block.

FIG. 3 illustrates the basics of directional encoding. After extraction of an absolute signal, for example, mono signal X(n), out of the four input signals FL(n), FR(n), RL(n), and RR(n), e.g., X(n)=¼(FL(n)+FR(n)+RL(n)+RR(n)), through a simple down-mix, one can place this mono signal X(n) in a room so that it again appears to come from the desired azimuth, provided by absolute directional information, for example, steering vector θ_Res (n), whereby the actual loudspeaker setup as utilized in the target room has to be taken into account. This can be done following the same principle as previously shown, (i.e., by using the VBAP algorithm).

Figure 4:
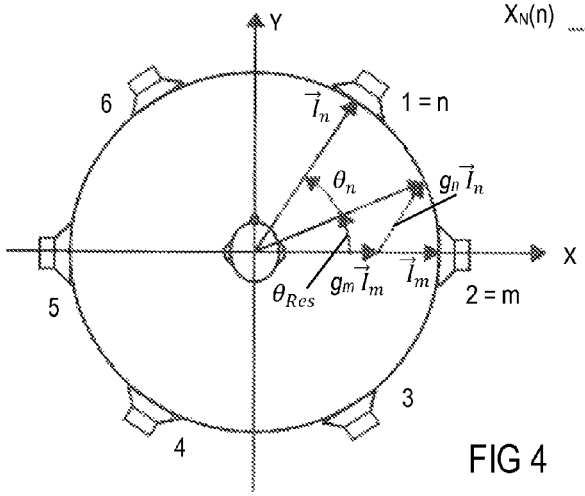
FIG. 4 is a diagram of an example of a 2D loudspeaker system with six loudspeakers employing the VBAP algorithm.

As shown in FIG. 4 and specified by the equations in the two subsequent paragraphs, the VBAP algorithm is able to provide a certain distribution of a mono sound to a given loudspeaker setup such that the resulting signal seems to come as close as possible from the desired direction, defined by steering vector θ_Res. In the example of FIG. 4, a regular two-dimensional placement (equidistant arrangement along a circumference) with L=6 loudspeakers 1-6 is assumed to be used in the target room. The resulting sound should come from the direction (determined by steering vector θ_Res) that points between the loudspeakers labeled 1=n and 2=m. As such, only these two loudspeakers 1 and 2 will be fed with the mono signal with gains that can be calculated following the mathematical procedures as set forth by the equations in the two subsequent paragraphs. At this point, it should be noted that VBAP is able to cope with any loudspeaker distribution so that irregular loudspeaker setups could be used as well.

The following relations hold for the VBAP algorithm:

$$\vec{l}_{Res} = g_n\vec{l}_n + g_m\vec{l}_m,$$

$$\vec{l}_{Res}^{\,T} = g\vec{L}_{n,m} \Rightarrow$$

-continued $$g = \vec{l}_{res}^{T}\vec{L}_{n,m}^{-1}, \text{ with}$$

$$\vec{l}_{Res} = [Res_x Res_y] = [\sin(\theta_{Res})\cos(\theta_{Res})],$$

$$\vec{l}_n = [n_x n_y] = [\sin(\theta_n)\cos(\theta_n)],$$

$$\vec{l}_m = [m_x m_y] = [\sin(\theta_m)\cos(\theta_m)],$$

$$g = [g_n g_m],$$

$$\vec{L}_{n,m} = [\vec{l}_n \vec{l}_m] = \begin{pmatrix} n_x & n_y \\ m_x & m_y \end{pmatrix} = \begin{pmatrix} \sin(\theta_n) & \cos(\theta_n) \\ \sin(\theta_m) & \cos(\theta_m) \end{pmatrix}, \Rightarrow$$

$$\vec{L}_{n,m}^{-1} = \left(\frac{1}{\sin(\theta_n)\cos(\theta_m) - \cos(\theta_n)\sin(\theta_m)}\right)\begin{pmatrix} \cos(\theta_m) & -\cos(\theta_n) \\ -\sin(\theta_m) & \sin(\theta_n) \end{pmatrix}, \text{ with}$$

$n$ = index of the limiting loudspeaker of the left side, $m$ = index of the limiting loudspeaker of the right side, $x$ = real part of the corresponding vector, $y$ = imaginary part of the corresponding vector, $\vec{l}_k$ = unit vector, pointing to the direction of the point $k$ at the unit circle The scaling condition of the VBAP algorithm is such that the resulting acoustic energy will remain constant under all circumstances. Further, a gain g must also be scaled such that the following condition always holds true:

$$\sqrt[p]{\sum_{k=1}^{k=1} g_k^p} = 1, \text{ with}$$

$L$ = number of speakers, $p$ = norm factor (e.g. $p = 2 \Rightarrow$ quadratic norm).

In order that the received sound always appears with a constant, non-fluctuating loudness, it is important that its energy remains constant at all times, (i.e., for any applied steering vector θ_Res). This can be achieved by following the relationship as outlined by the equation in the previous paragraph, in which the norm factor p depends on the room in which the speakers are arranged. In an anechoic chamber, a norm factor of p=1 may be used, whereas in a "common" listening room, which always has a certain degree of reflection, a norm factor of p≈2 might deliver better acoustic results. The exact norm factor has to be found empirically depending on the acoustic properties of the room in which the loudspeaker setup is installed.

In situations in which an active matrix algorithm such as "Logic 7®" ("L7"), Quantum Logic® ("QLS") or the like are already part of the audio system, these algorithms can also be used to place the down-mixed mono signal X(n) in the desired position in the room, as marked by the extracted steering vector 〖W〗_Res. The mono signal X(n) is modified in such a way that the active up-mixing algorithm can place the signal in the room as desired (i.e., as defined by steering vector 〗W〖_Res). In order to achieve this, the situation is first analyzed based on the previous example, as shown in FIG. 2, assuming a regular quadrophonic loudspeaker setup.

Figure 5:
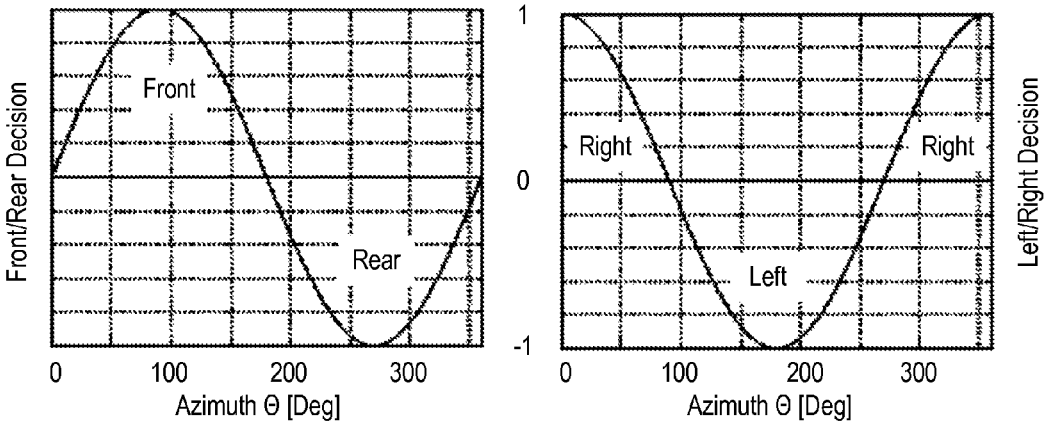
FIG. 5 is a diagram illustrating the front-to-back ratio and the left-to-right ratio of a quadrophonic loudspeaker setup.
Figure 6:
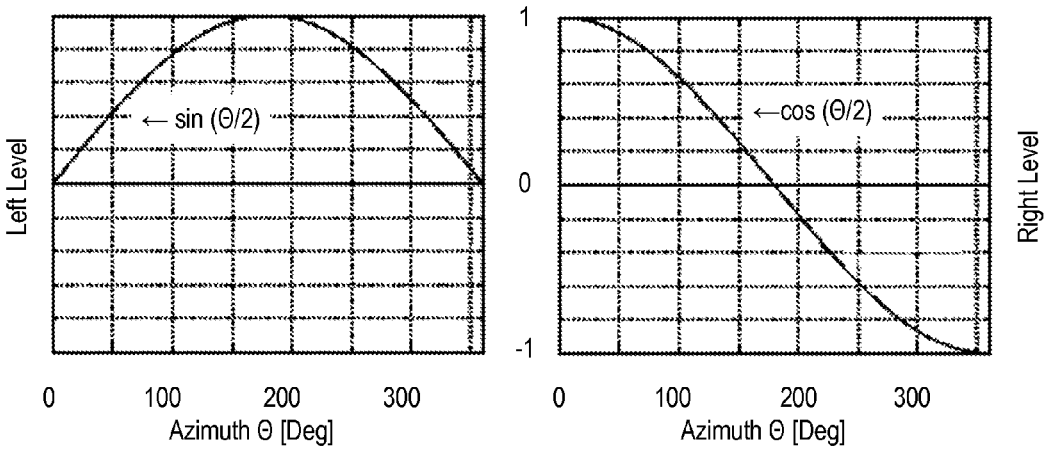
FIG. 6 is a diagram illustrating the panning functions when a stereo signal is used in the quadrophonic loudspeaker setup of FIG. 2.

By circling through the unit circle in a mathematically correct manner, as indicated in FIG. 2, trajectories, as depicted in FIG. 5, can be identified, in which the left graph depicts the front-to-back ratio (fader) and the right graph the left-to-right ratio (balance). When analyzing the localization of the resulting acoustics by its front-to-back ratio, which can be interpreted as fading, a sinusoidal graph results as shown by the left handed picture of FIG. 5; when analyzing the localization of the resulting acoustics by its left-to right ratio, which can be regarded as balancing, a graph, can be obtained, as depicted in the right picture of FIG. 5. As can be seen, the front-to-back ratio follows the shape of a sine function, whereas the left-to-right ratio shows the trajectory of a cosine function. FIG. 6 shows the resulting corresponding panning functions when a stereo input signal is used for the quadrophonic loudspeaker setup of FIG. 2.

When taking these two findings into account, it can be seen how the left and right signals have to be modified such that a following active up-mixing algorithm correspondingly distributes the signals to the loudspeaker setup at hand. This can be interpreted as follows:

a) The higher the amplitude of the left signal, the more the signal will be steered to the left; the higher the amplitude of the right signal, the more the signal can be localized to the right.

b) If both signals have the same strength, which is the case, for example, at θ=〖90〗° the resulting signal can be localized at the line in the center, (i.e., in-between the left and right hemispheres).

c) The panning will only be faded to the rear if the left and right signals differ in phase, which only applies if θ>〖180〗°.

In the case of L7 or QLS, a stereo input signal can be provided, based on a mono signal X(n) as follows:

$$L(n) = \sin\left(\frac{\theta}{2}\right)X(n),$$

$$R(n) = \cos\left(\frac{\theta}{2}\right)X(n), \text{ with}$$

$L(n)$ = left signal, $R(n)$ = right signal.

Figure 7:
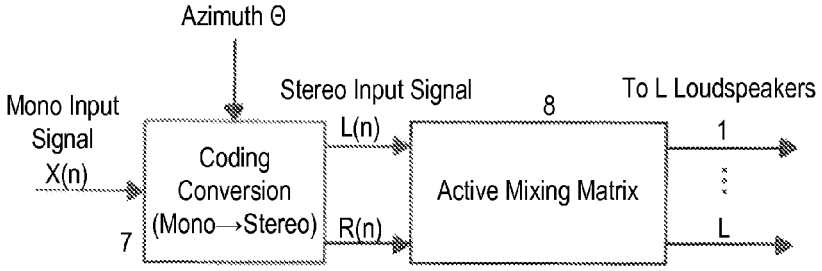
FIG. 7 is a block diagram illustrating coding conversion from mono to stereo, based on the desired horizontal localization in the form of the panning vector during creation of the directional coded stereo signal.

Referring now to FIG. 7, coding conversion from mono to stereo may take the desired horizontal localization θ(n) in the form of a panning vector into account during the creation of the directionally coded stereo signal, which may act as input to the downstream active mixing matrix. In the signal flow chart of FIG. 7, a monaural signal is supplied to coding conversion block 7 for converting the mono input signal X(n) into stereo input signals L(n) and R(n), which are supplied to an active mixing matrix 8. Active mixing matrix 8 provides L output signals for L loudspeakers (not shown).

The input signals X1(n), . . . , XN(n) may not only contain the signal that shall be steered to a certain direction, but also other signals that should not be steered. As an example, a head-unit of a vehicle entertainment system may provide a broadband stereo entertainment stream at its four outputs, where one or several directional coded, narrowband information signals, such as a park distance control (PDC) or a blind-angle warning signal, may be overlapped. In such a situation, the parts of the signals to be steered are first extracted. Under the stipulation that the information signals are narrow-band signals and can be extracted via simple bandpass (BP) or bandstop (BS) filtering, they can easily be extracted from the four head-unit output signals FL(n), FR(n), RL(n), and RR(n), as shown in FIG. 8.

Figure 8:
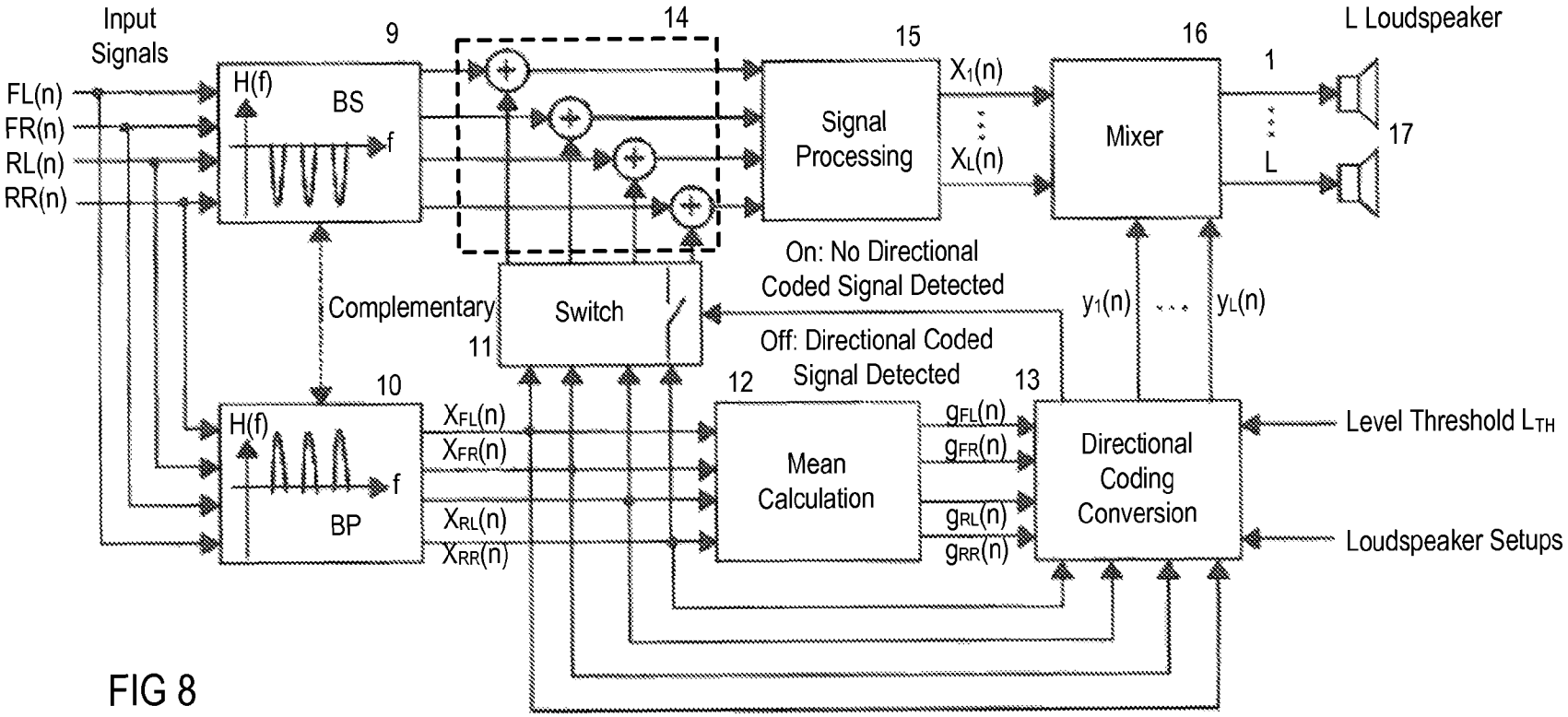
FIG. 8 is a block diagram of an example of an application of directional coding conversion.

In the signal flow chart of FIG. 8, the four input signals front left FL(n), front right FR(n), rear left RL(n), and rear right RR(n), as provided, for example, by the head-unit of a vehicle, are supplied to a band-stop (BS) filter block 9 and a complementary bandpass (BP) filter block 10, whose output signals XFL(n), XFR(n), XRL(n), and XRR(n) are supplied to switching block 11, mean calculation block 12, and directional coding conversion block 13. A control signal makes switching block 11 switching signals XFL(n), XFR (n), XRL(n), and XRR(n) to adding block 14, where they are summed up with the respective band-stop filtered input signals FL(n), FR(n), RL(n), and RR(n) to form output signals that are supplied to signal processing block 15. L output signals X1(n)-XL(n) of signal processing block 15 are supplied to mixer block 16, where they are mixed with output signals y1(n)-yL(n) from directional coding conversion block 13, which receives signals XFL(n), XFR(n), XRL(n) and XRR(n), in addition to gain signals gFL(n), gFR(n), gRL(n), and gRR(n), from the mean calculation block 12 and as further input level threshold signal LTH and information about the employed loudspeaker setup. Directional coding conversion block 13 also provides the control signal for switching block 11, wherein the switches of switching block 11 are turned on (closed) if no directional coding signal is detected and are turned off (opened) if any directional coding signal is detected. Mean calculation block 12 may include a smoothing filter, for example, an infinite impulse response (IIR) low-pass filter. Signal processing block 15 may perform an active up-mixing algorithm such as L7 or QLS. Mixing block 16 provides L output signals for, for example, L loudspeakers 17.

As can be seen from FIG. 8, narrowband, previously directional coded parts of the four input signals, originally stemming from the head-unit, which are assumed to include one or several fixed frequencies, are extracted via fixed BP filters in filter block 10. At the same time, these fixed parts of the spectrum are blocked from the broadband signals by fixed BS filters in filter block 9 before they are routed to the signal processing block 15.

If no directional coded signal can be detected, which is the case if none of the four extracted, narrow-band signals XFL(n), XFR(n), XRL(n), XRR(n), or their precise levels gFL(n), gFR(n), gRL(n), and gRR(n), exceed a given level threshold LTH, switch 11 will be closed, i.e., the four narrow-band signals XFL(n), XFR(n), XRL(n), and XRR(n) will be added to the broadband signal, from which those exact spectral parts had been blocked before, eventually building again the original broadband signals FL(n), FR(n), RL(n) and RR(n), provided that the BP and BS filters are complementary filters due to the fact that they add up to a neutral system. No directionally coded signals y1(n), . . . , yL(n), newly encoded for the loudspeaker setup at hand, will be generated. Hence, the whole audio system would act as normal, as if no directional coding conversion (DCC) block 13 were present.

On the other hand, if a directionally coded signal is detected, which is the case if one or more of the measured signal levels of the narrowband signals gFL(n), gFR(n), gRL(n), and gRR(n) exceed the level threshold LTH, the switch will be opened (i.e., broadband signals in which the directionally coded parts are blocked will be fed to signal processing block 15). At the same time, within DCC block 13, directionally coded signals y1(n), . . . , yL(n) will be generated and mixed by mixing block 16 downstream of signal processing block 15.

In the following, the steps taken within DCC block 13 will be described in detail.

Figure 9:
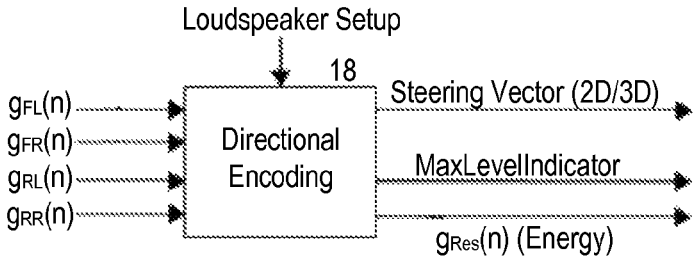
FIG. 9 is a block diagram illustrating directional encoding within the directional coding conversion block.

In a first step, directional encoding, i.e., extraction of the steering vector, for example, θ(n) for 2D systems, is performed in (for example) directional encoding block 18 based on a loudspeaker setup that may be provided by, for example, the encoding system. As can be seen from FIG. 9, which shows the directional encoding part of DCC block 13, the steering vector θ(n) and/or Φ(n) for the 2D and 3D cases, respectively, the total energy of the directional signal gRes (n), as well as the signal MaxLevelIndicator, will be provided at their outputs. The steering vector and the total energy can be calculated following the equations set forth above in connection with FIG. 2. The signal MaxLevelIndicator, indicating which of the narrow-band input signals XFL(n), XFR(n), XRL(n), or XRR(n) contains the most energy, can be generated by finding the index of vector g, containing the current energy values gFL(n), gFR(n), gRL (n), and gRR(n) of the narrow-band signals.

Figure 10:
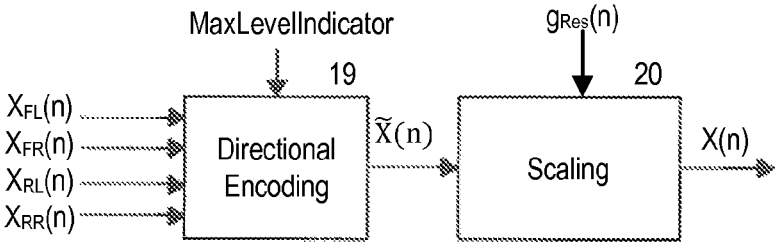
FIG. 10 is a block diagram illustrating the extraction of a mono signal.

In a second step, calculation of the mono signal X(n) is performed. As shown in FIG. 10, in order to get the desired mono output signal X(n), the narrowband signal $X^{-}(n)$ may be routed out of the four narrowband input signals XFL(n), XFR(n), XRL(n), and XRR(n) with the highest energy content by directional encoding block 19, which is controlled by the signal MaxLevelIndicator, to downstream scaling block 20, where the narrowband signal $X^{-}(n)$ will be scaled such that its energy equals the total energy gRes (n) of the previously detected directional signal.

Figure 11:
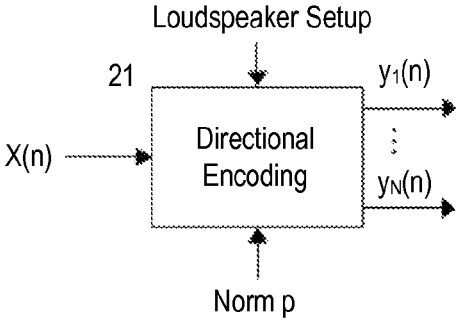
FIG. 11 is a block diagram illustrating coding conversion that utilizes the VBAP algorithm.

In a third step, coding conversion takes place, for example, coding conversion utilizing the VBAP algorithm, as shown in FIG. 11. One option to realize directional coding is to redo the coding, for example, with directional encoding block 21 utilizing the VBAP algorithm according to the equations set forth above in connection with FIG. 4, supplied with input signal X(n), information of the currently used loudspeaker setup, and the empirically found value of norm p, and providing output signals y1(n), . . . , yL(n). However, any other directional encoding algorithm may be used, such as an already existing active up-mixing algorithm like L7, QLS, or the algorithm described above in connection with FIG. 7.

Figure 12:
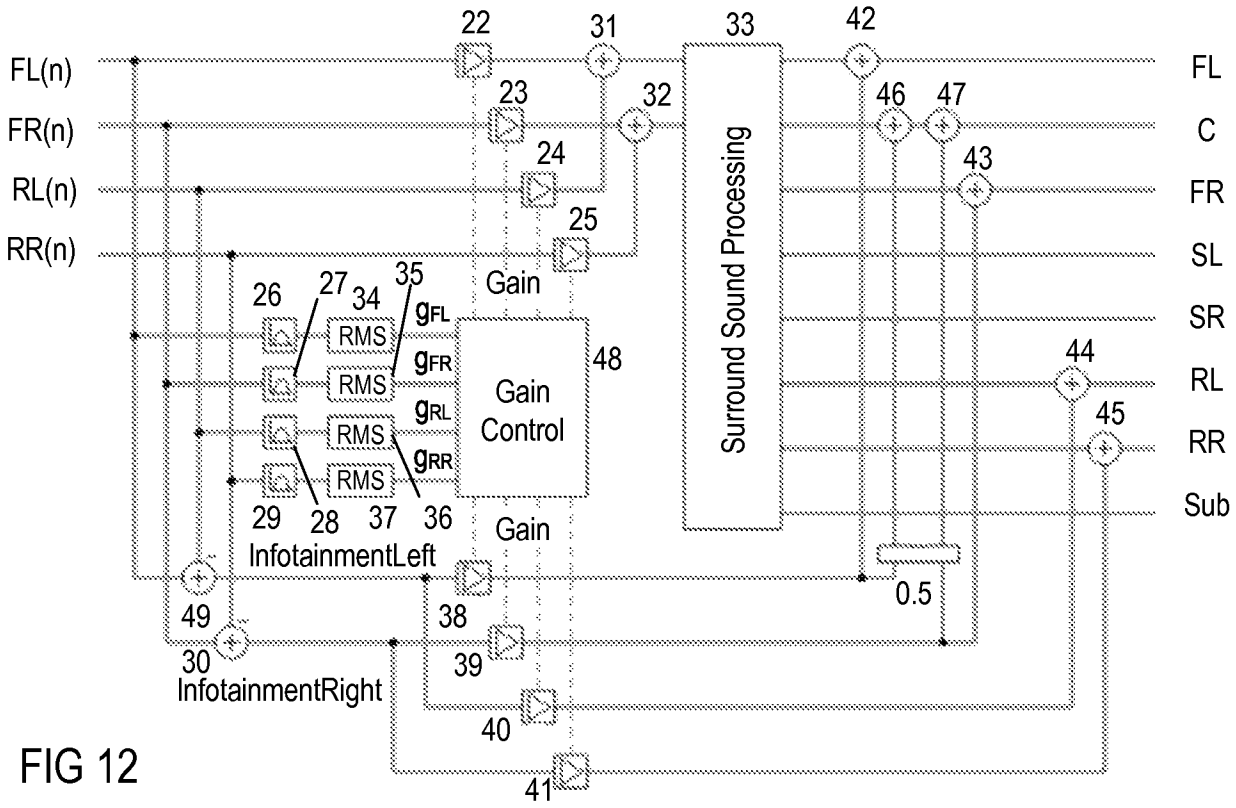
FIG. 12 is a practical realization that illustrates a lower consumption of processing time and memory resources.

An even more practical realization, due to its even lower consumption of processing time and memory resources, is depicted in FIG. 12. The four input signals FL(n), FR(n), RL(n), and RR(n) are supplied to four controllable gain amplifiers 22-25 and to four band-pass filters 26-29. Furthermore, the input signals FL(n) and RL(n) are supplied to subtractor 49, and the input signals FR(n) and RR(n) are supplied to subtractor 30. The output signals of controllable gain amplifiers 22 and 24, which correspond to input signals FL(n) and RL(n), are supplied to adder 31; the output signals of controllable gain amplifiers 23 and 25, which correspond to input signals FR(n) and RR(n), are supplied to adder 32. The output signals of adders 31 and 32 are supplied to surround sound processing block 33. Root-mean-square (RMS) calculation blocks 34-37 are connected downstream of band-pass filters 26-29 and upstream of gain control block 48, which controls the gains of controllable gain amplifiers 22-25 and 38-41. Controllable gain amplifiers 38 and 40 are supplied with the output signal InfotainmentLeft of subtractor 49; gain amplifiers 39 and 41 are supplied with the output signal InfotainmentRight of subtractor 30. Surround sound processing block 33 provides output signals for loudspeakers FL, C, FR, SL, SR, RL, RR, and Sub, wherein the output signal of controllable gain amplifier 38 is added to the signal for loudspeaker FL by adder 42, the output signal of controllable gain amplifier 39 is added to the signal for loudspeaker FR by adder 43, the output signal of controllable gain amplifier 40 is added to the signal for loudspeaker RL by adder 44, and the output signal of controllable gain amplifier 41 is added to the signal for loudspeaker RR by adder 45. Furthermore, half of the output signal of controllable gain amplifier 38 is added to the signal for loudspeaker C by adder 46 and half of the output signal of controllable gain amplifier 39 is added to the signal for loudspeaker C by adder 47, dependent on certain conditions as detailed below.

The signal flow in the system of FIG. 12 can be described as follows:

a) The left-to-right ratio will be treated by the active up-mixing algorithm, which employs, for example, the QLS algorithm. Gain control block 48 makes sure that the only stereo input signals that are fed to the active up-mixing algorithm are those that do not contain or which only contain the weaker directionally coded signals (i.e., the ones with less energy).

b) The front-to-rear ratio can be obtained by routing the left differential signals FL(n)-RL(n), namely InfotainmentLeft at the output of subtractor 49, to left loudspeakers FL, C, and RL, and by routing the right differential signals FR(n)-RR(n), namely InfotainmentRight at the output of subtractor 30, to right loudspeakers FR, C, and RR, whose strength is again controlled according to the gain values from gain control block 48. Here the gains are adjusted so that the differential signals InfotainmentLeft and the analogous InfotainmentRight will be routed to the front if the energy content of the narrow-band signal gFL(n)>gRL(n), or gFR(n)>gRR(n), and vice versa to the rear, if gFL(n)<gRL(n), or gFR(n)<gRR(n). Thus, if the frontal energy is higher than the dorsal, the differential signals InfotainmentLeft and InfotainmentRight will solely be sent to the front loudspeakers; if the dorsal energy is higher than the frontal, the differential signals InfotainmentLeft and InfotainmentRight will exclusively be sent to the rear loudspeakers.

c) By taking the difference of the left and right signals FL(n)-RL(n) and FR(n)-RR(n), the directionally coded signals can be extracted; in other words, subtraction allows for blocking any non-directionally coded signals out of the broadband signal, assuming that the head-unit allocates non-directionally coded left and right signals equally to the front and rear channels, without yielding any modifications to them in terms of delay, gain, or filtering.

d) Gain control block 48 is, as discussed above, solely based on the narrow-band directionally coded energy contents, provided by vector g=[gFL(n),gFR(n),gRL(n),gRR(n)]. The switching mimic in the system of FIG. 12 is as follows:

If RMS FL>RMS RL(gRL), then
Entertainment Gain FL=0,
Entertainment Gain RL=1,
Infotainment Gain FL=1,
Infotainment Gain RL=0.
If RMS FL<RMS RL(gRL), then
Entertainment Gain FL=1,
Entertainment Gain RL=0,
Infotainment Gain FL=0,
Infotainment Gain RL=1.
If RMS FL=RMS RL(gRL), then
Entertainment Gain FL=0.5,
Entertainment Gain RL=0.5,
Infotainment Gain FL=0,
Infotainment Gain RL=0.

The switching mimic for the right-hand side works analogously.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A directional coding conversion method comprising:

receiving input audio signals that comprise directional audio coded signals into which directional audio information is encoded according to a first loudspeaker setup;

extracting the directional audio coded signals from the received input audio signals;

decoding, according to the first loudspeaker setup, the extracted directional audio coded signals to provide at least one absolute audio signal and corresponding absolute directional information;

processing the at least one absolute audio signal and the absolute directional information to provide first output audio signals that are coded according to a second loudspeaker setup;

extracting first signals other than the directional audio coded signals from the received input audio signals;

processing the first signals other than the directional audio coded signals to provide second output audio signals; and mixing the first output audio signals with the second output audio signals to provide loudspeaker signals for the second loudspeaker setup.

2. The method of claim 1, wherein extracting the directional audio coded signals from the received input audio signals comprises band-pass filtering.

3. The method of claim 1, wherein directional encoding comprises at least one of scaling, normalizing or threshold comparison.

4. The method of claim 1, wherein processing the first signals other than the directional audio coded signals comprises directionally encoding, according to the second loudspeaker setup, the first signals other than the directional audio coded signals with given directional information to provide the second output audio signals.

5. The method of claim 4, further comprising using the first signals other than the directional audio coded signals as the at least one absolute audio signal and the directional information to provide the first output audio signals if no directional audio coded signals from the received input audio signals are extracted.

6. The method of claim 1, wherein processing the first signals other than the directional audio coded signals comprises calculating mean values of the first signals other than the directional audio coded signals to provide gain control signals that control the gain of the second output audio signals for the second loudspeaker setup.

7. The method of claim 1, wherein extracting the first signals other than the directional audio coded signals from the received input audio signals comprises bandpass filtering.

8. A directional coding conversion system comprising:

input lines configured to receive input audio signals that comprise directional audio coded signals into which directional audio information is encoded according to a first loudspeaker setup;

an extractor block configured to extract the directional audio coded signals from the received input audio signals, wherein the extractor block is further configured to extract first signals other than the directional audio coded signals from the received input audio signals;

a decoder block configured to decode, according to the first loudspeaker setup, the extracted directional audio coded signals to provide at least one absolute audio signal and corresponding absolute directional information;

a first processor block configured to process the at least one absolute audio signal and the absolute directional information to provide first output audio signals that are coded according to a second loudspeaker setup;

a second processor block configured to process the first signals other than the directional audio coded signals to provide second output audio signals; and a mixer block configured to mix the first output audio signals with the second output audio signals to provide loudspeaker signals for the second loudspeaker setup.

9. The system of claim 8, wherein the extracting block comprises a band-pass filtering block.

10. The system of claim 8, wherein the second processor block is configured to calculate mean values of the first signals other than the directional audio coded signals to provide gain control signals that control the gain of the second output audio signals for the second loudspeaker setup.

11. The system of claim 8, wherein the second processor block comprises a directional encoding block configured to encode, according to the second loudspeaker setup, the first signals other than the directional audio coded signals with given directional information to provide the second output audio signals.

12. The system of claim 11, wherein the first processor block is configured to use the first signals other than the directional audio coded signals as the at least one absolute audio signal and the absolute directional information to provide the first output audio signals for the second loudspeaker setup if no directional audio coded signals from the received input audio signals are extracted.

13. The system of claim 11, wherein the directional encoding block is configured to perform at least one of scaling, norming or threshold comparison.

14. A system for performing directional coding conversion, the system comprising:

an extractor block configured to extract directional audio coded signals from input audio signals as received at input lines, the directional audio coded signals including directional audio information that is encoded according to a first loudspeaker setup, wherein the extractor block is further configured to extract first signals other than the directional audio coded signals from the received input audio signals;

a decoder block configured to decode, according to the first loudspeaker setup, the extracted directional audio coded signals to provide at least one absolute audio signal and corresponding absolute directional information;

a first processor block configured to process the at least one absolute audio signal and the absolute directional information to provide first output audio signals that are coded according to a second loudspeaker setup;

a second processor block configured to process the first signals other than the directional audio coded signals to provide second output audio signals; and a mixer block configured to mix the first output audio signals with the second output audio signals to provide loudspeaker signals for the second loudspeaker setup.

15. The system of claim 14, wherein the extracting block comprises a band-pass filtering block.

16. The system of claim 14, wherein the second processor block is configured to calculate mean values of the first signals other than the directional audio coded signals to provide gain control signals that control the gain of the second output audio signals for the second loudspeaker setup.

17. The system of claim 14, wherein the second processor block comprises a directional encoding block configured to encode, according to the second loudspeaker setup, the first signals other than the directional audio coded signals with given directional information to provide the second output audio signals.

* * * * *